US010787180B2

(12) United States Patent
Marnas

(10) Patent No.: US 10,787,180 B2
(45) Date of Patent: Sep. 29, 2020

(54) CABLE TRANSPORT INSTALLATION

(71) Applicant: POMA, Voreppe (FR)

(72) Inventor: Luc Marnas, Saint-Nizier-du-Moucherotte (FR)

(73) Assignee: POMA, Voreppe (FR)

( * ) Notice: Subject to any disclaimer, the term of this patent is extended or adjusted under 35 U.S.C. 154(b) by 202 days.

(21) Appl. No.: 15/758,117

(22) PCT Filed: Oct. 6, 2016

(86) PCT No.: PCT/FR2016/052572
§ 371 (c)(1),
(2) Date: Mar. 7, 2018

(87) PCT Pub. No.: WO2017/060632
PCT Pub. Date: Apr. 13, 2017

(65) Prior Publication Data

US 2018/0244289 A1 Aug. 30, 2018

(30) Foreign Application Priority Data

Oct. 6, 2015 (FR) ..... 15 59494

(51) Int. Cl.
*B61B 12/10* (2006.01)
*B61B 7/04* (2006.01)
*B61B 12/02* (2006.01)

(52) U.S. Cl.
CPC ..... *B61B 12/10* (2013.01); *B61B 7/04* (2013.01); *B61B 12/02* (2013.01)

(58) Field of Classification Search
CPC ..... B61B 12/00; B61B 12/02; B61B 12/04; B61B 12/06; B61B 12/10; B61B 12/122; B61B 12/127
See application file for complete search history.

(56) References Cited

U.S. PATENT DOCUMENTS

| | | | |
|---|---|---|---|
| 4,898,100 A | 2/1990 | Brochand | |
| 2008/0148989 A1 | 6/2008 | Moritzhuber | |

FOREIGN PATENT DOCUMENTS

| | | | | |
|---|---|---|---|---|
| AT | 108924 B | 2/1928 | | |
| AT | 398950 B | 2/1995 | | |
| CN | 101200185 A | 6/2008 | | |
| EP | 0282418 A1 | 9/1988 | | |
| JP | H5-345562 A | 12/1993 | | |
| WO | 2015/071573 A2 | 5/2015 | | |
| WO | WO-2015071573 A2 * | 5/2015 | ..... | B61B 7/04 |

OTHER PUBLICATIONS

Jan. 26, 2017 International Search Report issued in International Patent Application No. PCT/FR2016/052572.

(Continued)

*Primary Examiner* — Robert J McCarry, Jr.
(74) *Attorney, Agent, or Firm* — Oliff PLC

(57) ABSTRACT

Cable transport installation, including: at least one carrier, a first hauling cable to haul at least one carrier and describing a first closed loop, and a second hauling cable to haul at least one carrier and describing a second closed loop, the second loop surrounding the first loop so as to create a separating space between the first and second hauling cables.

16 Claims, 8 Drawing Sheets

(56) References Cited

OTHER PUBLICATIONS

Mar. 27, 2019 Office Action issued in Chinese Patent Application No. 201680057415.X.
Apr. 24, 2020 Office Action issued in Japanese Application No. 2018-517508.
Apr. 10, 2018 Internalional Preliminary Report on Patentability issued in International Patent Application No. PCT/FR2016/052572.

* cited by examiner

CABLE TRANSPORT INSTALLATION

BACKGROUND OF THE INVENTION

The invention relates to cable transport installations, and more particularly to aerial cable transport installations.

STATE OF THE ART

Aerial cableways, such as chairlifts or gondola lifts, are currently used to transport passengers pursuing leisure activities in the mountains. These aerial cableways may momentarily break down and prevent transport of passengers until the aerial cableway has been put back in service.

It is therefore useful to provide an aerial cableway, or a ground cable transport installation, ensuring a minimum passenger transit rate.

Aerial cable installations comprising two independent aerial cableways arranged in parallel exist at the present time. Each aerial cableway comprises a single cabin, and is of to-and-fro type, i.e. the outward and incoming run of the cabin take place on the same track. This installation procures a certain flexibility in the passenger transit rate, for if an aerial cableway breaks down, the second aerial cableway can take over to perform transport of the passengers. Such an installation does however present the shortcoming of having a low passenger transit rate, as it is necessary to wait for the return of the cabin which is running to be able to proceed to load passengers again.

OBJECT OF THE INVENTION

The object of the invention consists in remedying these shortcomings, and more particularly in providing a cable transport installation which can ensure a minimum passenger transit rate.

Another object of the invention consists in providing an installation having small overall dimensions.

According to one feature of the invention, a cable transport installation is proposed comprising at least one carrier, a first hauling cable to haul a carrier and describing a first closed loop, and a second hauling cable to haul a carrier and describing a second closed loop.

In this installation, the second loop surrounds the first loop so as to create a separating space between the first and second hauling cables.

An installation is thus provided enabling the availability of the carriers for loading and unloading of the passengers to be enhanced. Indeed, driving of a first hauling cable can be stopped, for example to perform maintenance or in case of a breakdown, while keeping the possibility of using the second hauling cable. Such an installation thereby ensures redundancy of driving of the carriers. Furthermore, when the second hauling cable surrounds the first hauling cable, each running track of the carriers can comprise a single hauling cable, i.e. they do not comprise return of the hauling cable as is the case of current installations, thereby reducing the lateral space occupation of the carrier running tracks.

The installation can comprise a loading/unloading platform situated inside the separating space.

The installation can comprise a first running track for a carrier hauled by the first hauling cable, and a second running track for a carrier hauled by the second hauling cable, the length of the first running track being shorter than that of the second running track.

The installation can comprise a carrier equipped with a detachable clamp to couple the carrier in removable manner to at least one hauling cable.

The installation can comprise a first drive means of the first hauling cable along the first running track, and a second drive means of the second hauling cable along the second running track, the second drive means being distinct from the first drive means.

At least one drive means of a hauling cable can comprise a driving pulley and two diverting pulleys to divert the hauling cable in the direction of the driving pulley.

According to one embodiment, the axis of rotation of the driving pulley and the axes of rotation of the diverting pulleys are horizontal.

The drive means can also comprise two inflection pulleys to bend the hauling cable in the direction of the driving pulley, the axis of rotation of the driving pulley being vertical and the axes of rotation of the diverting pulleys and of the inflection pulleys being horizontal.

According to another embodiment, the axis of rotation of the driving pulley and the axes of rotation of the diverting pulleys are vertical.

The installation can comprise a running space situated between the two diverting pulleys, and a disengagement circuit for a carrier passing through the running space in order to remove the carrier from the hauling cable.

The first and second hauling cables can be aerial hauling cables suspended above the ground and the carrier comprises a cabin and a hanger arm coupling the cabin to the clamp of the carrier, the hanger arm being located inside the separating space when the carrier is coupled to the hauling cable.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
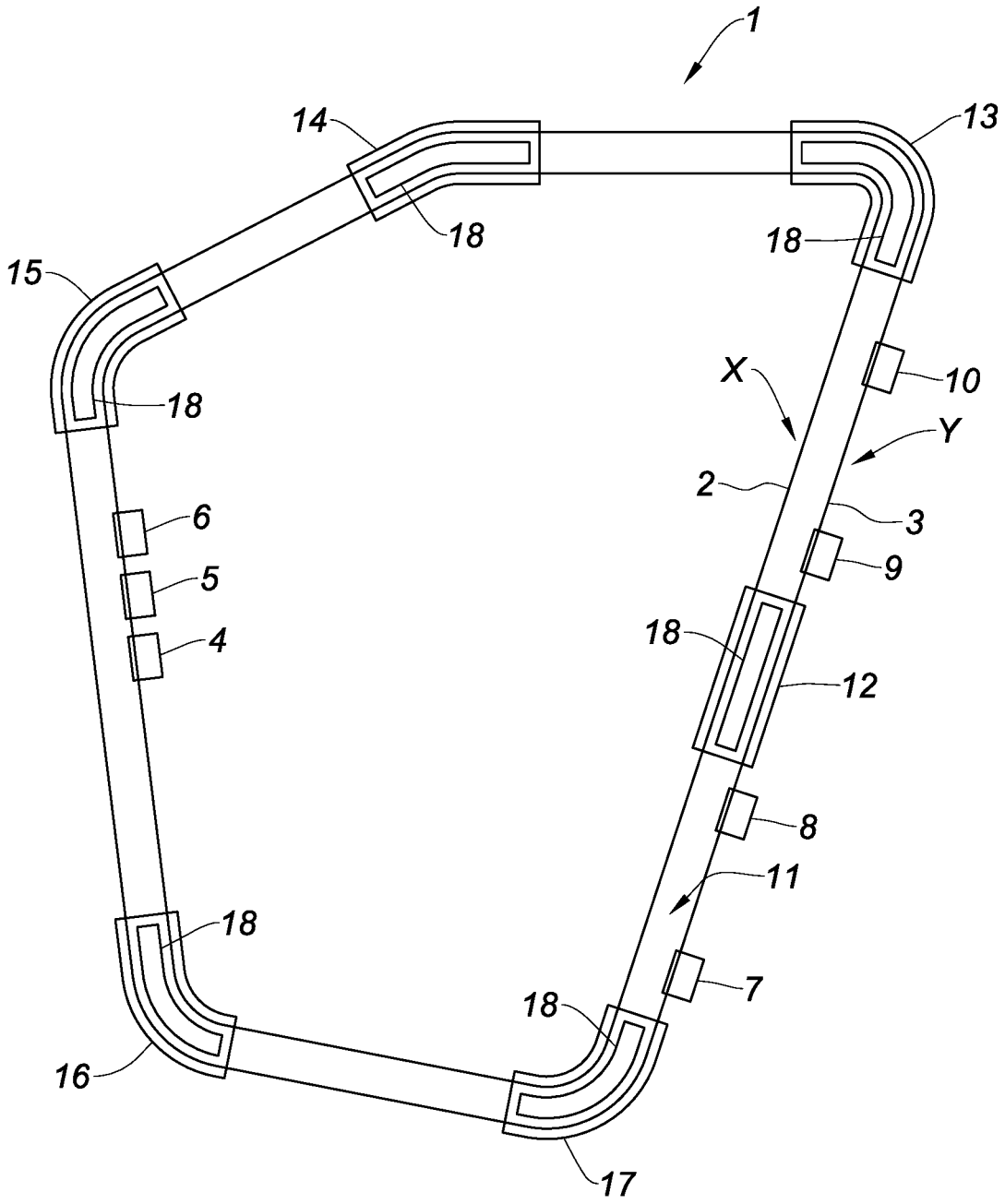
FIG. 1 schematically illustrates an embodiment of a cable transport installation according to the invention.

In FIG. 1, a transport installation 1 by cable 2, 3 has been represented. The installation 1 comprises at least one carrier 4 to 10, a first hauling cable 2 to haul a carrier 4 to 10 and describing a first closed loop, and a second hauling cable 3 to haul a carrier 4 to 10 describing a second closed loop. The carriers 4 to 10 are designed to be coupled to at least one hauling cable 2, 3 to be hauled in order to transport passengers or goods. The carriers 4 to 10 can be designed to transport passengers and comprise an open passenger space, such as chairs, or a closed passenger compartment such as cabins, or they can be designed to transport goods and are containers.

Figure 9:
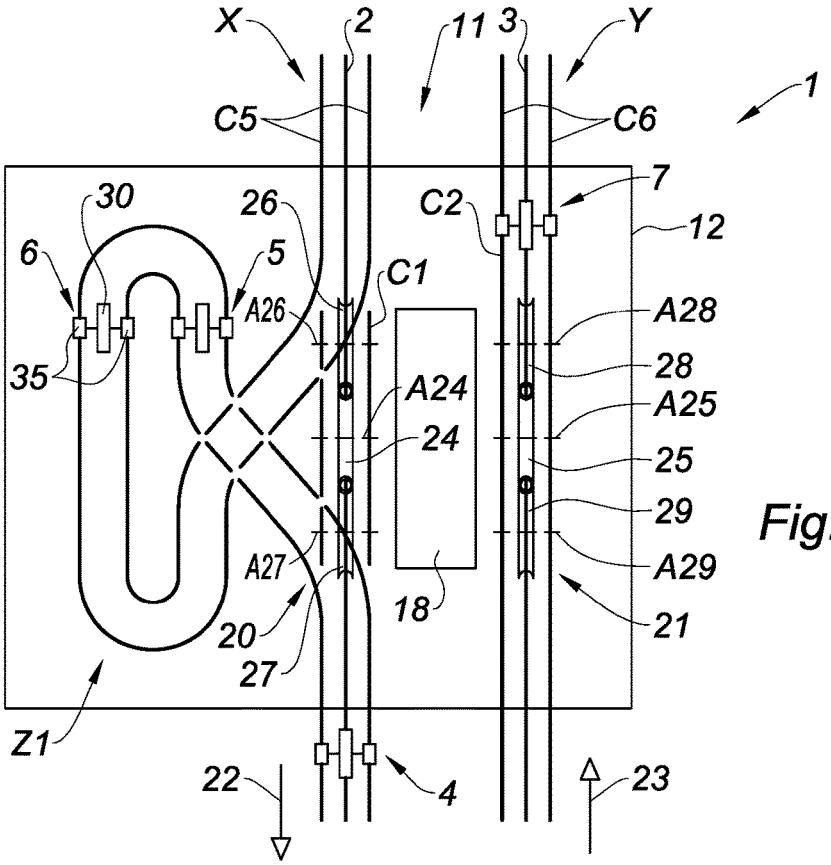
FIG. 9 schematically illustrates a top view of another embodiment of a cable transport installation according to the invention.
Figure 10:
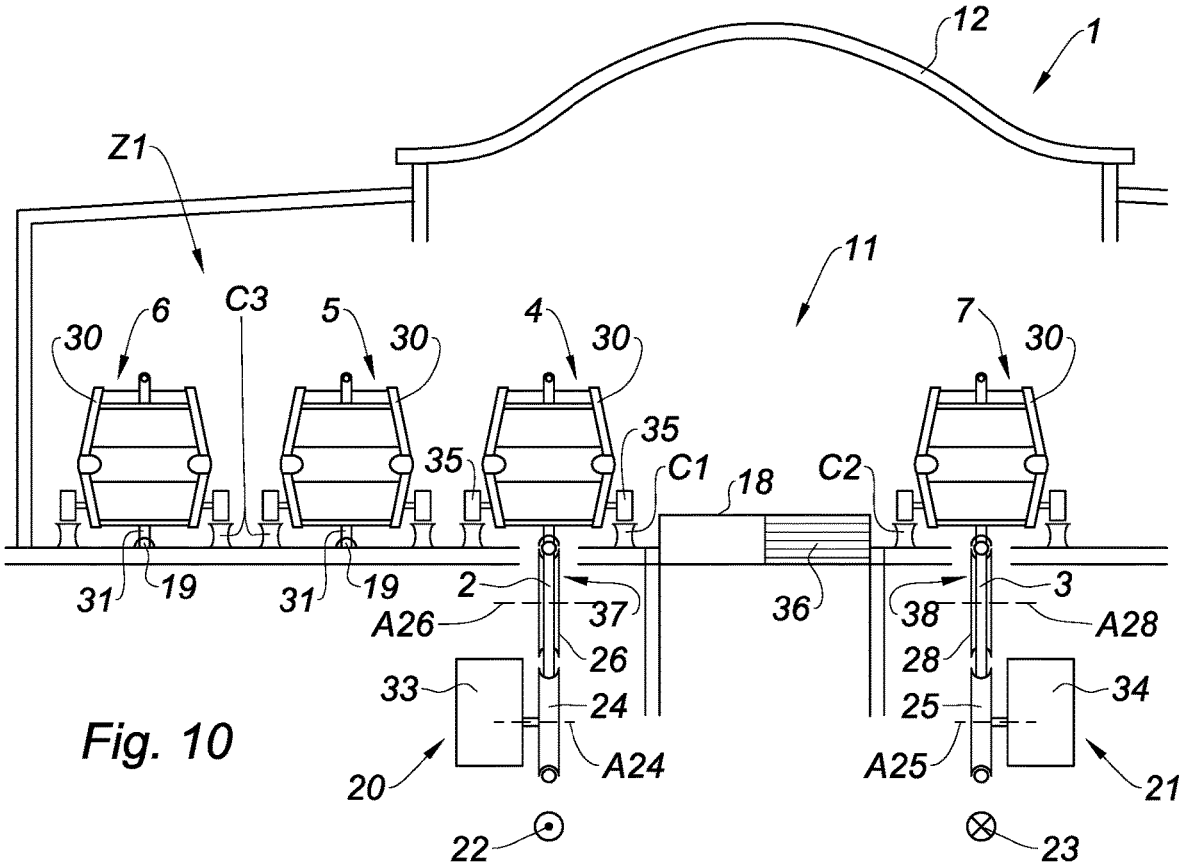
FIG. 10 schematically illustrates a front view of the embodiment of FIG. 9.

In general manner, the installation 1 comprises a first running track X for a carrier 4 to 6 along which the first hauling cable 2 is driven, and a second running track Y for a carrier 7 to 10 along which the second hauling cable 3 is driven. In FIG. 1, three carriers 4 to 6 coupled to the first hauling cable 2 and four carriers 7 to 10 coupled to the second hauling cable 3 have been represented. The spacing between the carriers 4 to 10 running along one and the same track X, Y is not necessarily constant. The spacing between the carriers 4 to 10 can vary from one track to the other. In other words, the running tracks X, Y are independent. The installation 1 can be of aerial cableway type, i.e. the hauling cables 2, 3 are aerial and the carriers 4 to 10 are suspended above the ground, as illustrated in FIGS. 2 to 8. As a variant, the installation 1 can be of ground cableway type and the hauling cables 2, 3 are located at ground level, as illustrated in FIGS. 9 and 10. According to this variant, the installation 1 comprises a support structure having several support rails on the ground on which the carriers 4 to 10 are placed. It can also be envisaged for the installation 1 to be of mixed type comprising one running track X, Y of aerial cableway type and one running track X, Y of ground cableway type. Furthermore, when a running track X, Y is of aerial cableway type, it can comprise a single cable 2, 3 that is both hauling and carrying cable, or comprise a hauling cable 2, 3 and several carrying cables, or there again comprise two hauling cables arranged in parallel and driven in the same running direction with one or more carrying cables or without any carrying cables. When a running track X, Y is of ground cableway type, it can comprise a single hauling cable 2, 3 or two hauling cables arranged in parallel manner and driven in the same running direction.

More particularly, the second closed loop described by the second hauling cable 3 surrounds the first closed loop described by the first hauling cable 2, so that a separating space 11 is created between the first and second hauling cables 2, 3. In other words, the second running track Y surrounds the first running track X. What is meant by "surrounds" is the fact that the first closed loop described by the first hauling cable 2 is situated inside the second closed loop described by the second hauling cable 3. That is to say that the first running track X is positioned inside the second running track Y. Such an arrangement of the hauling cables 2, 3 makes it possible to ensure a greater availability of the carriers 4 to 10 in order to guarantee a minimum passenger transit rate. Indeed, when a running track X, Y breaks down or is undergoing maintenance, running of the hauling cable of the track X, Y is stopped, and the passengers can use the other running track X, Y, the associated hauling cable 2, 3 of which is in operation. For example, the running tracks X, Y can be parallel over the whole of their travel path. According to one embodiment, the length of the first running track X is shorter than that of the second running track Y. According to another embodiment, the length of the first hauling cable 2 is shorter than that of the second hauling cable 3.

The installation 1 can comprise one or more terminals 12 to 17. The terminals 12 to 17 are designed for loading/unloading of the passengers in and out of the carriers 4 to 10. A terminal 12 to 17 can comprise a platform 18 for loading and/or unloading of the passengers. In particular, the platforms 18 of the terminals 12 to 17 are located inside the separating space 11. The platform 18 facilitates access for the passengers to the two running tracks X, Y. From one and the same platform 11, a passenger can choose to enter a carrier 4 to 10 running along one track X, Y or along the other track X, Y. The installation 1 therefore enables a passenger to travel from one terminal 12 to 17 to the other by taking one or the other of the running tracks X, Y. Transport of the passengers is thus ensured from one terminal 12 to 17 to any of the other terminals 12 to 17, even if one of the running tracks X, Y is no longer in operation. The position of the platforms 18 situated between the hauling cables 2, 3 allows the lateral dimensions of the terminals 12 to 17 to be reduced, in other words the ground occupation surface of the terminals 12 to 17 is reduced.

The carriers 4 to 10 are further equipped with a clamp 19 to couple them to a hauling cable 2, 3, as illustrated in FIGS. 2 to 8 and 10. Preferentially, the clamps 19 are of detachable type. A detachable clamp 19 couples a carrier 4 to 10 to a hauling cable 2, 3 in removable manner, i.e. it allows a carrier 4 to 10 to be detached from a hauling cable 2, 3. What is meant by "detached" is that the carrier 4 to 10 is not mechanically connected to a hauling cable 2, 3, in other words the carrier 4 to 10 is not in mechanical contact with the hauling cable 2, 3. On the contrary, what is meant by "coupled" is the fact that the carrier 4 to 10 is mechanically connected to a hauling cable 2, 3, i.e. that the carrier 4 to 10 is in mechanical contact with the hauling cable 2, 3 and the carrier is secured to the hauling cable 2, 3. Furthermore, a detachable clamp 19 can occupy a closed position to couple the carrier 4 to 10 so that it is hauled by the hauling cable 2, 3 and can occupy an open position to detach it from the hauling cable 2, 3.

According to a preferred embodiment, the installation 1 is a transport installation of detachable type, i.e. the carriers 4 to 10 each comprise a detachable clamp 19. An installation 1 of detachable type enables the passenger transit rate to be increased as it is not necessary to stop the hauling cables 2, 3 to immobilise the carriers 4 to 10 at the level of the platforms 18 so that the passengers can enter or exit the carriers 4 to 10.

In general manner, the installation 1 comprises a first drive means 20 of the first hauling cable 2 along the first running track X, and a second drive means 21 of the second hauling cable 3 along the second running track Y. Preferably, the second drive means 21 is distinct from the first drive means 20 in order to ensure redundancy of the running tracks X, Y. In other words the drive means 20, 21 are independent. The drive means 20, 21 can be configured to each drive a hauling cable 2, 3 in a running direction 22, 23. For example the hauling cables 2, 3 can be driven in the same running direction 22 or in two opposite directions 22, 23. As a variant, the drive means 20, 21 can be reversible and can reverse the running direction of the hauling cables 2, 3. A drive means 20, 21 can for example comprise a driving pulley 24, 25. When the installation 1 comprises a running track X, Y of detachable type, i.e. when the carriers 4 to 10 running on the track X, Y are each equipped with a detachable clamp 19, the drive means 20, 21 associated with the running track X, Y advantageously comprises two diverting pulleys 26 to 29 to divert the hauling cable 2, 3 which it drives in the direction of its driving pulley 24, 25. Due to the diverting pulleys 26 to 29, the driving pulley 24, 25 can be located offset with respect to the running track of the carriers 4 to 10. The driving pulley 24, 25 driving a hauling cable 2, 3 can be located inside or outside the closed loop described by the hauling cable 2, 3 which it drives. In particular, when a running track X, Y is detachable and the associated driving pulley 24, 25 is located inside the closed loop described by the hauling cable 2, 3 which it drives, the detached carriers are extracted from the hauling cable 2, 3 towards the inside of the track X, Y, i.e. towards the inside of the closed loop described by the cable. On the contrary, when the driving pulley 24, 25 is located outside the closed loop described by the hauling cable 2, 3 which it drives, the detached carriers are extracted from the hauling cable 2, 3 towards the outside of the track X, Y, i.e. towards the outside of the closed loop described by the cable. Advantageously, the driving pulley 25 driving the second hauling cable 3 is positioned inside the second closed loop and the driving pulley 24 driving the first hauling cable 2 is positioned outside the first closed loop. In this way, the carriers 4 to 6 running along the first track X can be extracted towards the outside of the first track X, and the carriers 7 to 10 running along the second track Y can be extracted towards the inside of the second track Y. In other words, each carrier 4 to 10 can be extracted from a hauling cable 2, 3 to the separating space 11, i.e. to the platform 18 of a terminal 12 to 17. The overall dimensions of the terminals 12 to 17 are thereby reduced. It can also be noted in FIGS. 2 and 4 that the driving pulley 24 driving the first hauling cable 2 is located inside the second loop and that the driving pulley 25 driving the second hauling cable 3 is located outside the first loop. It can also be noted that the driving pulleys 24, 25 can be positioned at a distance from the loading/unloading platform 18.

In FIGS. 2 to 10, different embodiments of the drive means 20, 21 of the hauling cables 2, 3 have been represented. In general manner, the terminal 12 where a drive means 20, 21 of a hauling cable 2, 3 is situated is denoted as being a drive terminal. The drive means 20, 21 can be situated in the same drive terminal 12. It can be envisaged to place the first drive means 20 in one terminal 12 to 17 and the second drive means 21 in another different terminal 12 to 17.

In FIGS. 2 to 8, an installation 1 of detachable aerial cableway type has been represented. The installation 1 comprises two aerial hauling cables 2, 3, and the carriers 4 to 10 each comprise a transport cabin 30 and a hanger arm 31. The hanger arm 31 of a carrier 4 to 10 couples the cabin 30 to the clamp 19 of the carrier 4 to 10. The hanger arm 31 is preferably located inside the separating space 11 when the carrier 4 to 10 is coupled to the hauling cable 2, 3.

Figure 2:
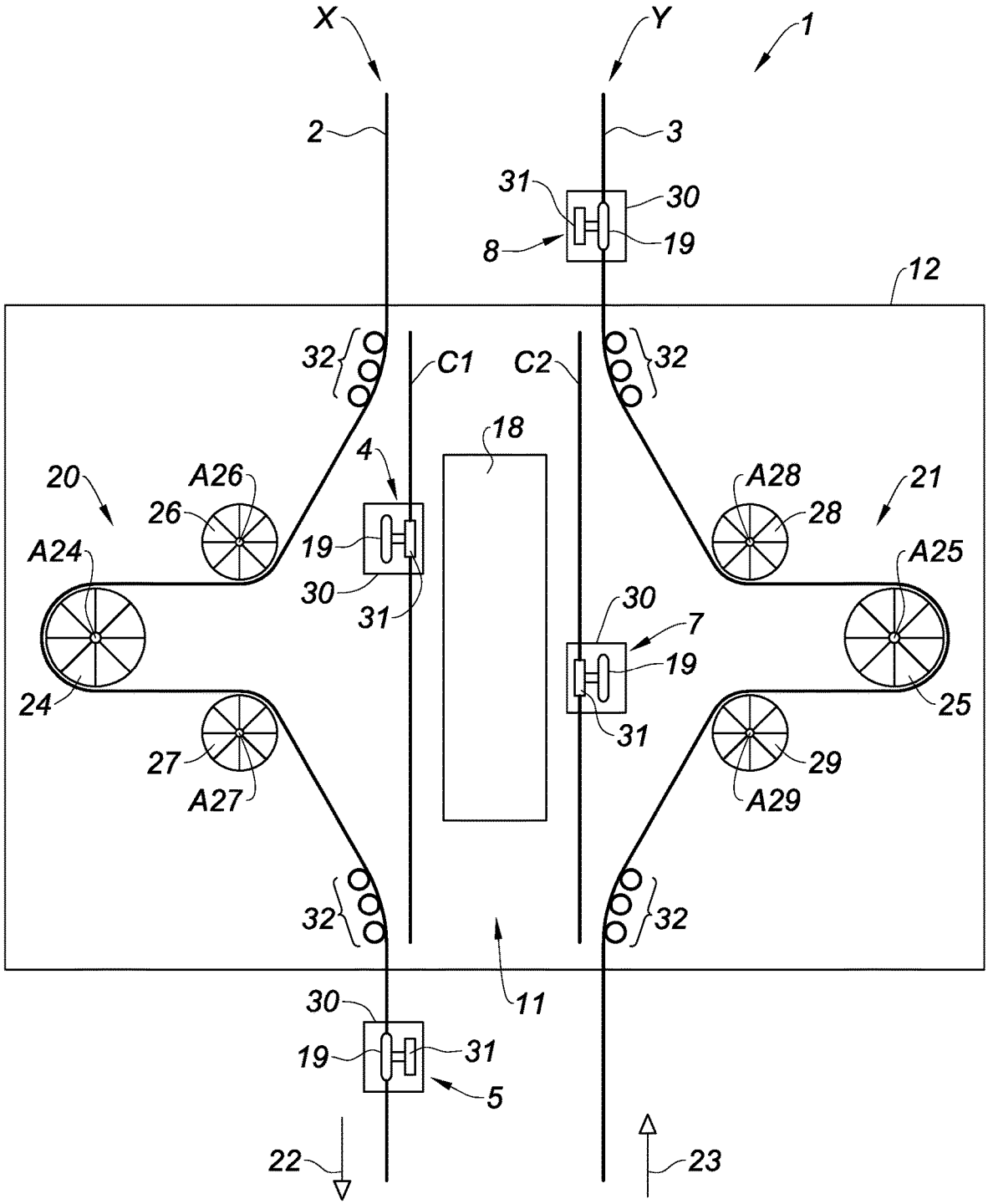
FIG. 2 schematically illustrates a top view of an embodiment of the drive means of the hauling cables of the installation.

In FIG. 2, an embodiment of the installation 1 has been represented wherein the axes of rotation A24, A25 of the driving pulleys 24, 25 and the axes of rotation A26 to A29 of the diverting pulleys are vertical, i.e. perpendicular to the sheet plane of FIG. 2, the vertical being a direction which follows the direction of gravity.

The carriers 4, 5 and 7, 8 have also been represented in two different positions in the installation 1 in FIG. 2. A first carrier 4 is situated in the terminal 12 where it runs along a first bypass circuit C1 of the terminal 12. The terminal 12 also comprises a second bypass circuit C2. The first carrier 4 is also said to be detached, i.e. it is uncoupled from the first hauling cable 2. In this case, the clamp 19 is in an open position and the first carrier 4 is detached from the first hauling cable 2. The first carrier 4 is thus unlatched from the hauling cable 2, the first carrier 4 also being said to be extracted from the hauling cable 2. The first carrier 4 is detached and runs along the first bypass circuit C1 to pass round the driving pulley 24 of the first drive means 20. Then, after loading/unloading of the passengers, the first carrier 4 is coupled to the first hauling cable 2 again to exit from the terminal 12. A second carrier 5 is situated outside the terminal 12. The clamp 19 of the second carrier 5 is in a closed position and the second carrier 5 is hauled by the first hauling cable 2 at a running speed of the first cable 2. A third carrier 8 is also situated outside the terminal 12, and is coupled and hauled by the second hauling cable 3. A fourth carrier 7 is detached from the second hauling cable 3 and runs along the second bypass circuit C2 to bypass the driving pulley 25 of the second drive means 21. The first and fourth carriers 4, 7 can be stopped so that they are immobile when the passengers enter or exit the carriers from the platform 18. The installation 1 can further comprise four groups of horizontal sheaves 32 placed on entry and exit of the terminal 12 to divert the hauling cables 2, 3 in the direction of the driving pulleys 24, 25, and more particularly in the direction of the diverting pulleys 26 to 29.

Figure 3:
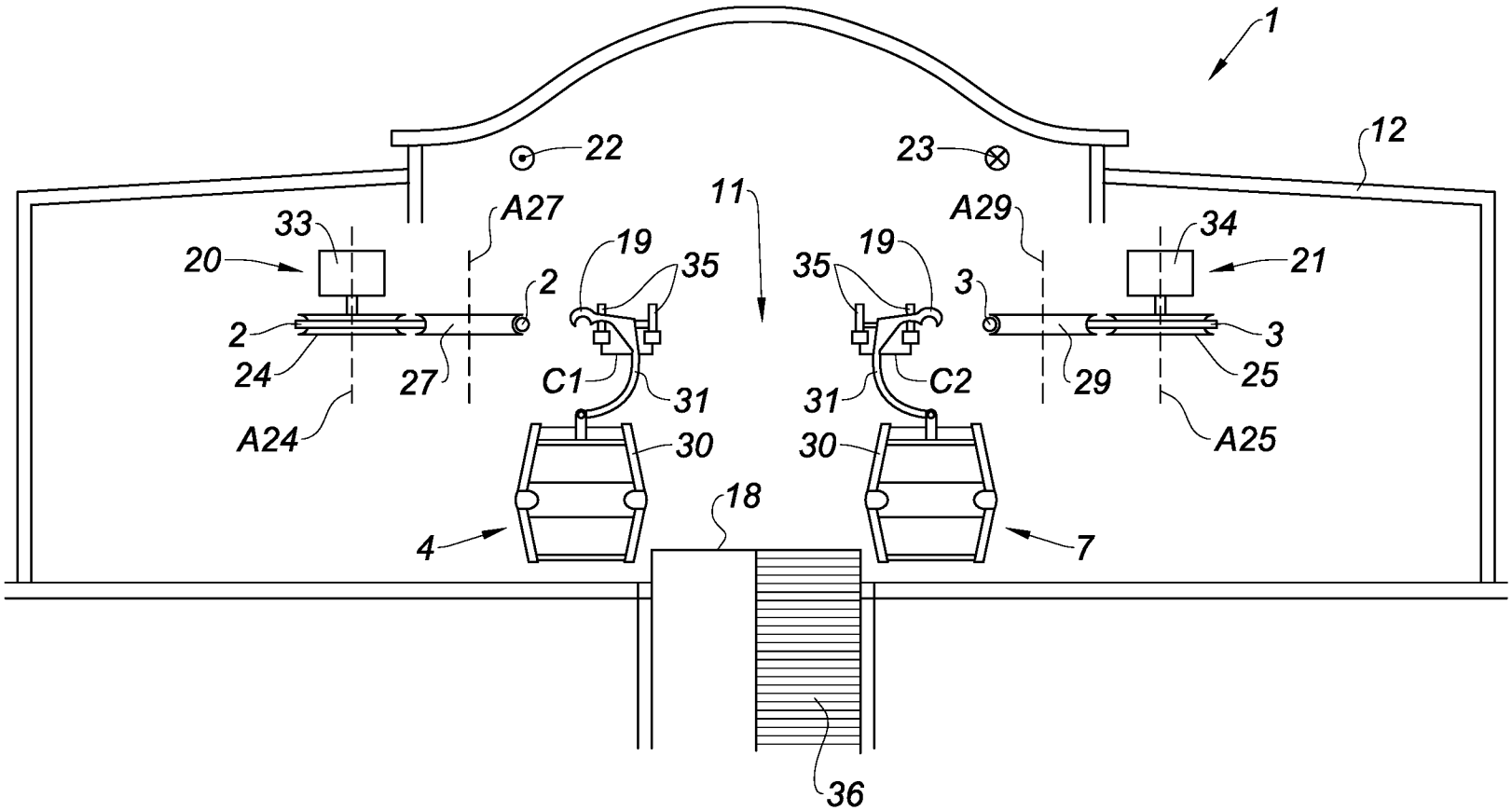
FIG. 3 schematically illustrates a front view of the embodiment of FIG. 2.

Motors 33, 34 to drive the driving pulleys 24, 25 respectively in rotation have also been represented in FIG. 3. The motors 33, 34 have vertical output shafts respectively coupled to the driving pulleys 24, 25. The hanger arm 31 of a carrier 4 to 10 can further comprise wheels 35 to run on bypass circuits C1, C2 in order to move the carriers 4 to 10 in the terminals 12 to 17. The installation 1 can further comprise an access means 36, such as a stairway, or an escalator, or a lift, to the platform 18 when the latter is situated above ground level.

Figure 4:
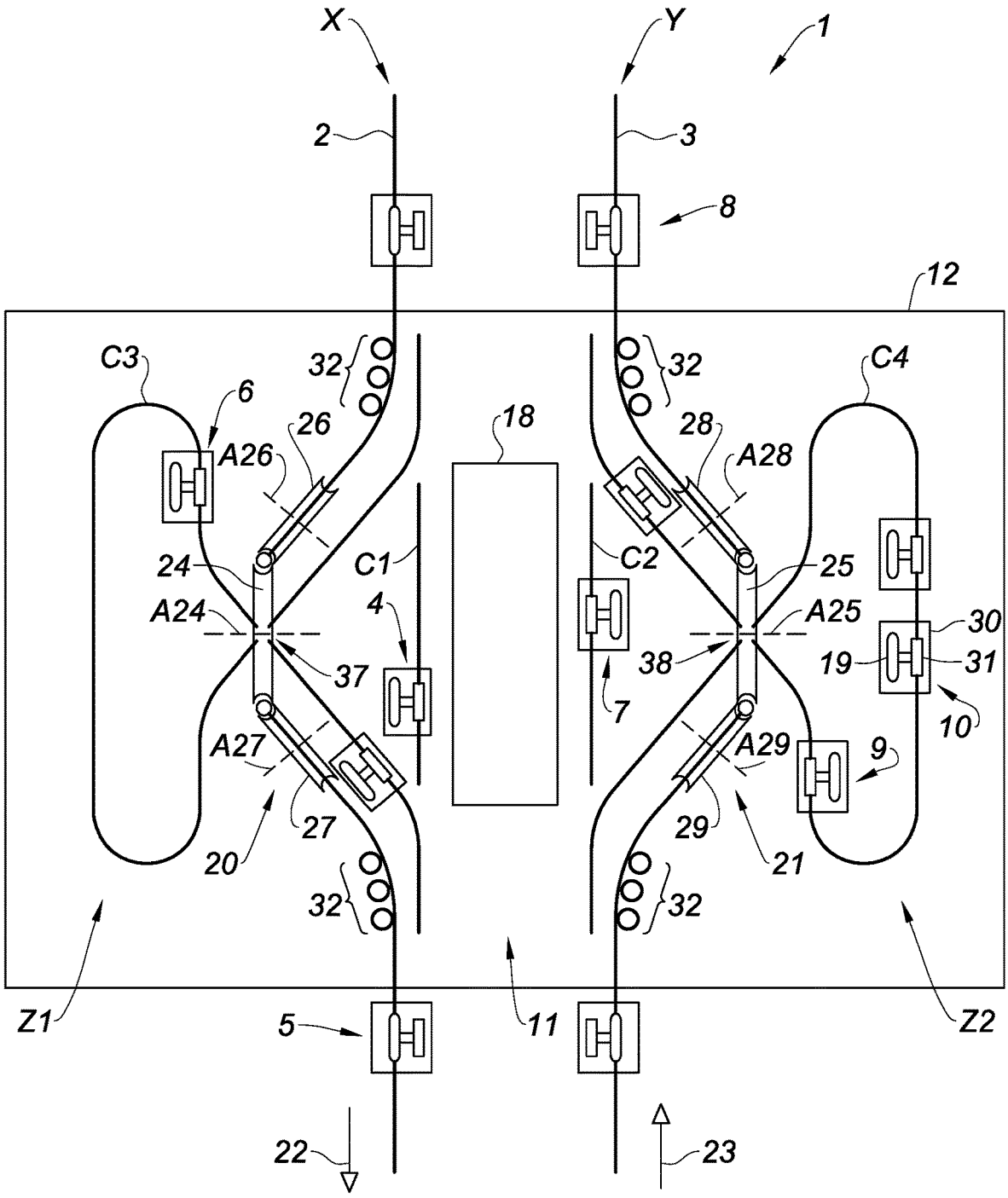
FIG. 4 schematically illustrates a top view of another embodiment of the drive means of the hauling cables of the installation.
Figure 5:
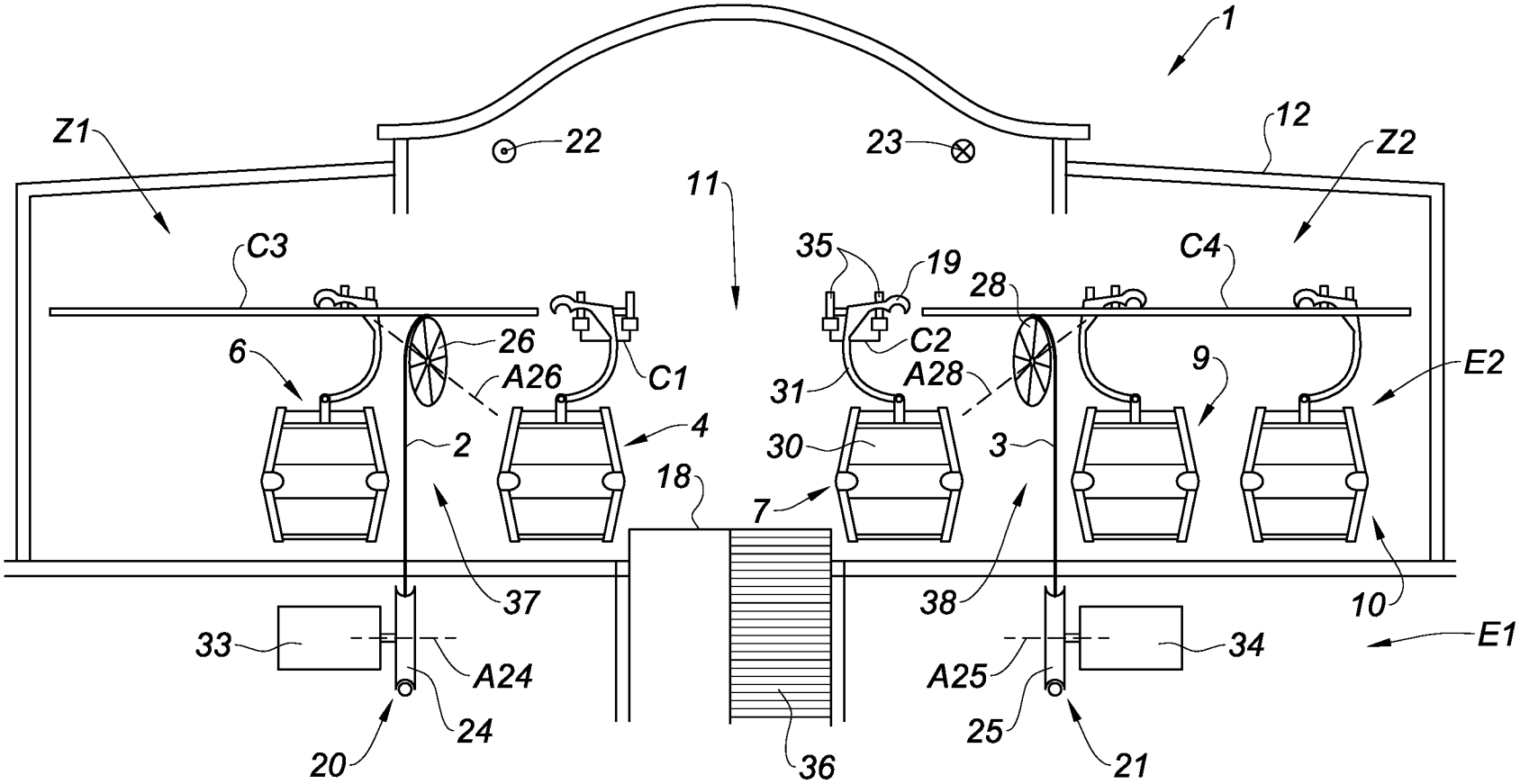
FIG. 5 schematically illustrates a front view of the embodiment of FIG. 4.

Yet another embodiment of the invention has been represented in FIGS. 4 and 5. In FIGS. 4 and 5, certain component parts illustrated in the previous figures have been represented. In this embodiment, the axes of rotation A24, A25 of the driving pulleys 24, 25 and the axes of rotation A26 to A29 of the diverting pulleys 26 to 29 are horizontal, i.e. they are perpendicular to the vertical. The diverting pulleys 26 to 29 can therefore be positioned on a first level E2 of the terminal 12. The driving pulleys 24, 25 can then be positioned on a second level E1 located above the first level E2 or below the first level E2. Preferably, the driving pulleys 24, 25 are positioned on the level E1 located below the level E2 where the diverting pulleys 26 to 29 are positioned in order to reduce the lateral dimensions of the terminal 12.

Furthermore, positioning a driving pulley 24, 25 on a different level from the one where the hauling cable 2, 3 is running enables the carriers 4 to 10 to be removed from the bypass circuits C1, C2 to a parking area Z1, Z2. In particular, the diverting pulleys 26, 27 of the first hauling cable 2 can be positioned at a distance from one another to create a running space 37 between the pulleys 26, 27. This running space 37 provides a passage for a first disengagement circuit C3 for carriers. Each parking area Z1, Z2 comprises a disengagement circuit C3, C4 to store the carriers 4 to 10 which have been detached from the hauling cables 2, 3. The first disengagement circuit C3 passes through the running space 37 in order to remove carriers 4 to 6 from the hauling cable 2. In the same way, the diverting pulleys 28, 29 of the second hauling cable 3 can be positioned at a distance from one another to create another running space 38 between the pulleys 28, 29. This other running space 38 provides a passage for the second disengagement circuit C4 for carriers. A carrier suspended on the first disengagement circuit C3 has been assigned the reference numeral 6, and two carriers suspended on the second disengagement circuit C4 have been assigned the reference numerals 9, 10. It can be noted that, according to this embodiment, the output shafts of the motors 33, 34 are also horizontal. When a carrier 4 to 10 enters a terminal, it is removed from the hauling cable 2, 3 and runs along the bypass circuit C1, C2. Then the carrier 4 to 10 is either recoupled to the hauling cable 2, 3 to exit from the terminal 12 to 17, or the carrier 4 to 10 is moved, by means of a track switch, onto a disengagement circuit C3, C4 to be stored in a parking area Z1, Z2. Inversely, a carrier 4 to 10 stored in a parking area Z1, Z2 can be moved, by means of a track switch, onto a bypass circuit C1, C2 for the carrier 4 to 10 to be coupled back onto a hauling cable 2, 3 to exit from the terminal 12 to 17.

Figure 6:
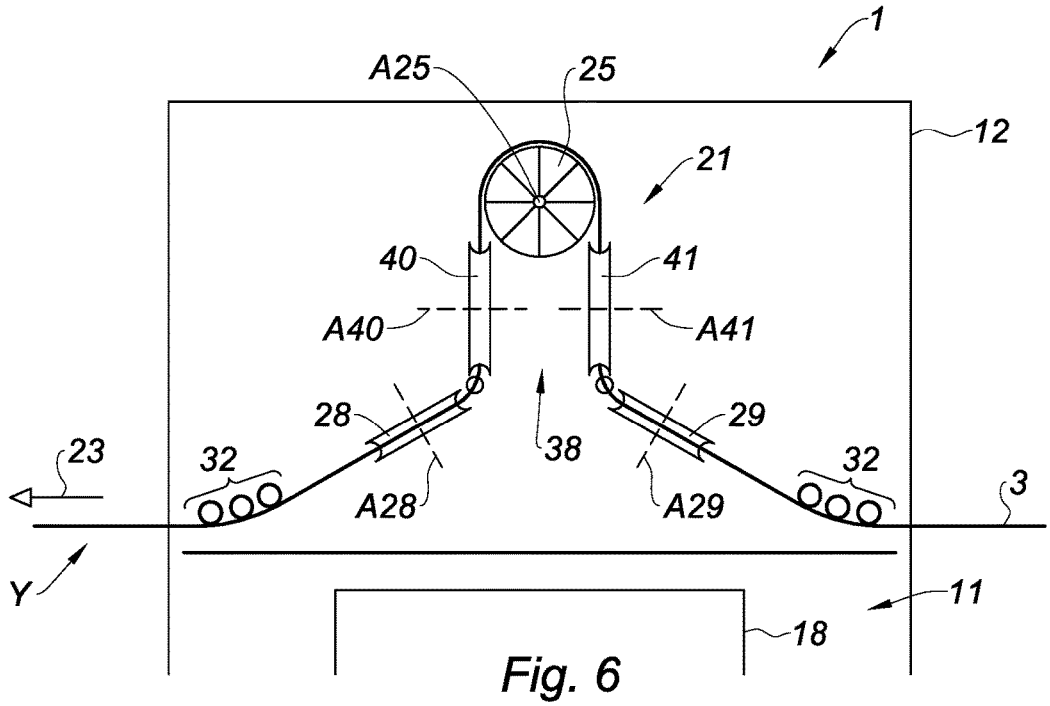
FIG. 6 schematically illustrates a top view of yet another embodiment of the drive means of a hauling cable of the installation.
Figure 7:
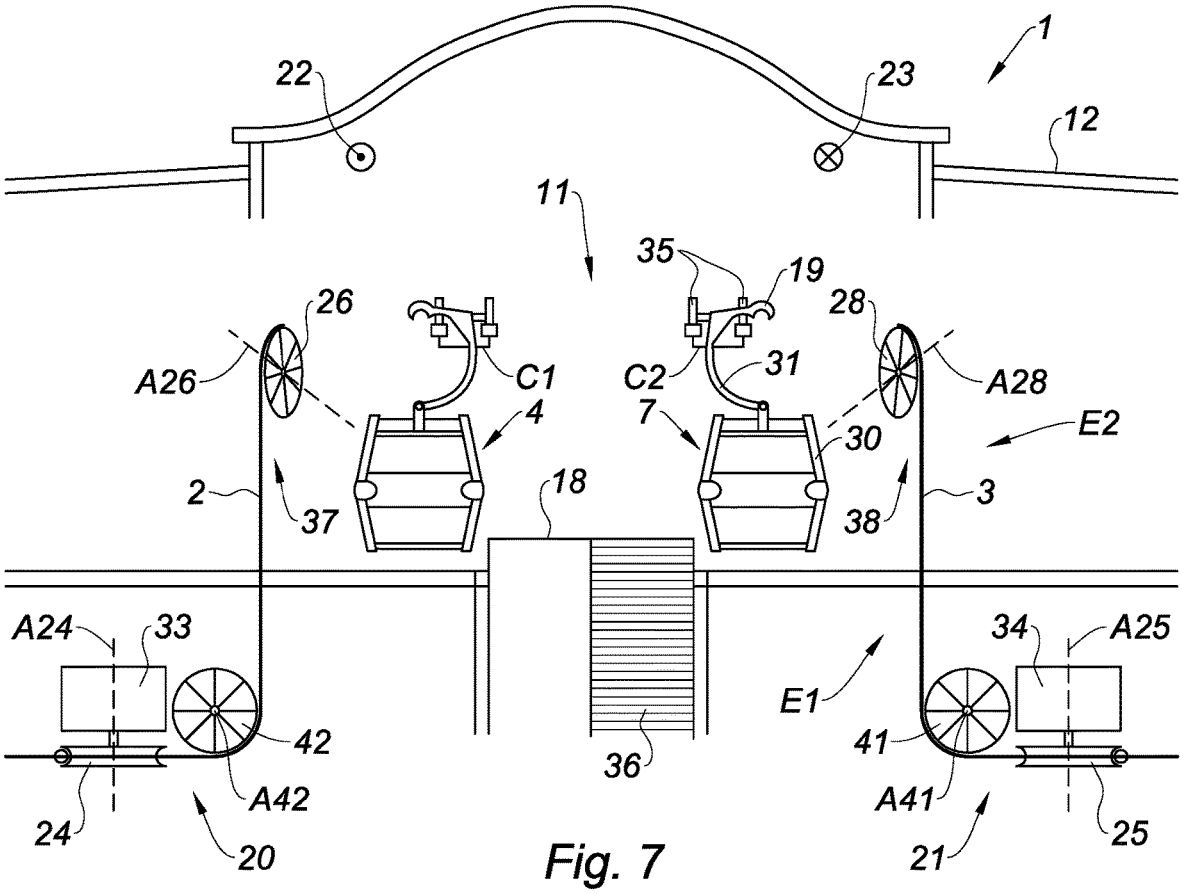
FIG. 7 schematically illustrates a front view of another embodiment of the drive means of the hauling cables of the installation.

In FIGS. 6 and 7, another embodiment of the invention has been represented in which the output shafts of the motors 33, 34 are vertical. According to this other embodiment, the second drive means 21 comprise two inflection pulleys 40, 41 to bend the second hauling cable 3 in the direction of the driving pulley 25. The respective axes of rotation A40, A41 of the inflection pulleys 40, 41 are horizontal, and the axis of rotation A25 of the driving pulley 25 is vertical. More particularly, the axes of rotation A40, A41 of the inflection pulleys 40, 41 are coaxial. The first drive means 20 can have the same configuration as that described for the second drive means 21. Advantageously, the two drive means 20, 21 have the same configuration, as illustrated in FIG. 7. In FIG. 7, an inflection pulley of the first drive means 20 has been assigned the reference numeral 42 and its axis of rotation the reference numeral A42, its second inflection pulley not being represented for the sake of simplification. A driving pulley 24, 25 can thus be placed on a different level E1 from the level E2 where the diverting pulleys 26 to 29 are situated, in order to create a running space 37, 38 to remove the carriers 4 to 10 from the hauling cables 2, 3, while continuing to drive the driving pulleys 24, 25 by a motor 33, 34 with a vertical output shaft.

Figure 8:
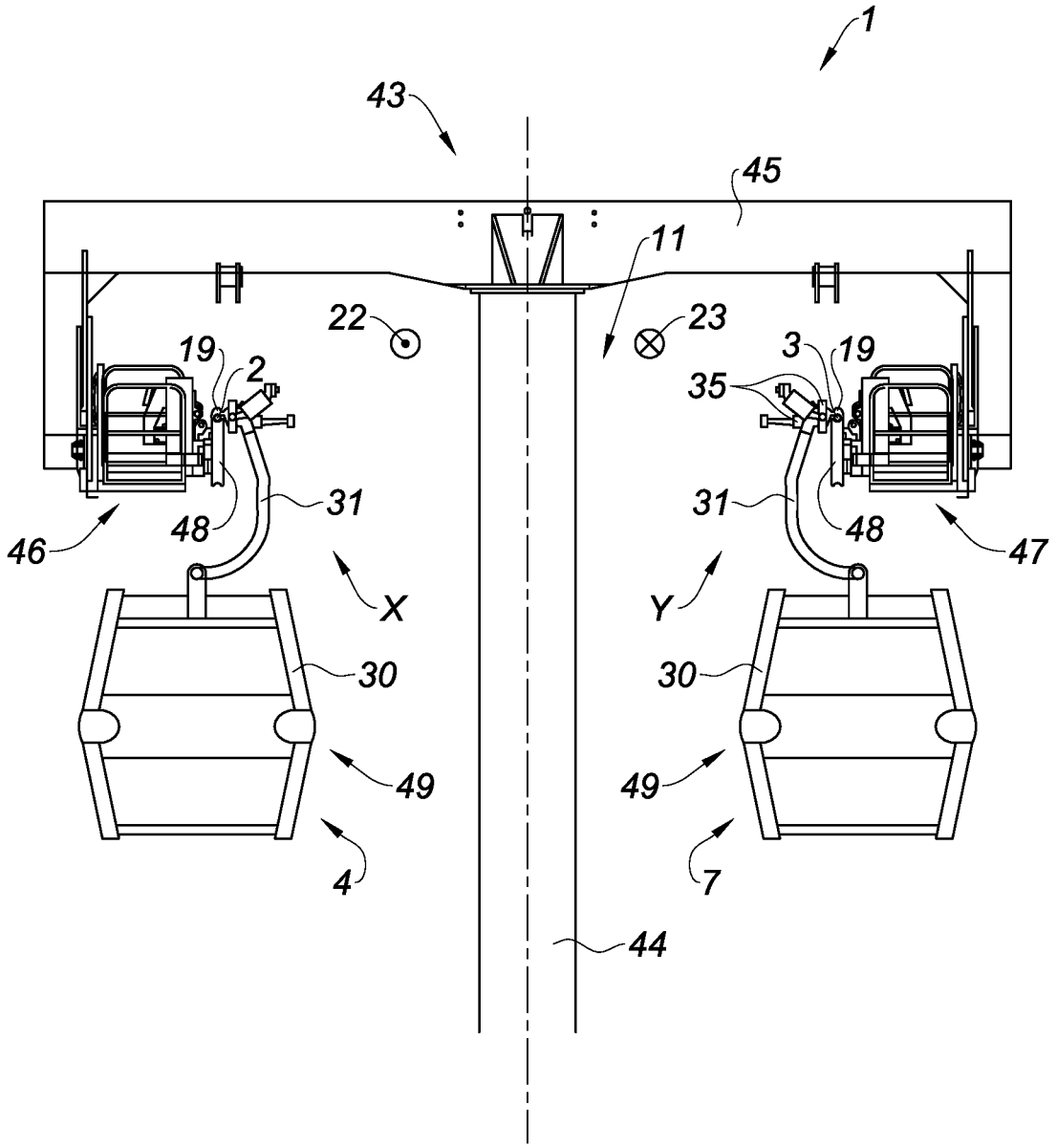
FIG. 8 schematically illustrates a front view of an embodiment of the hanger arms of the carriers of the installation.

A pillar 43 suitable for an installation 1 having two aerial hauling cables 2, 3 has been represented in FIG. 8. The pillar 43 comprises a body 44, a head 45 mounted on one end of the body 44, and two sheave assemblies 46, 47 respectively mounted on the two lateral ends of the head 45 of the pillar 43. Each sheave assembly comprises sheaves 48 mounted rotating to allow passage of the hauling cables 2, 3 and of the clamps 19 of the carriers 4 to 10. In particular, the bodies 44 of the pillars 43 are located between the hauling cables 2, 3, and more particularly in the separating space 11. In order to reduce the lateral space occupation of the running tracks X, Y, the hanger arms 31 of the carriers 4 to 10 running along a running track X, Y are situated between the bodies 44 of the pillars 43 and the sheave assemblies 46, 47 which support or compress the hauling cable 2, 3 associated with the track X, Y. The carriers 4 to 10 each further have openings 49 situated on the same side as the hanger arms 31, i.e. the openings are facing the bodies 44 of the pillars 43 when the carriers 4 to 10 pass the pillars 43.

An installation 1 of detachable ground cable transport type has been represented in FIGS. 9 and 10. The installation 1 comprises two hauling cables 2, 3, at ground level. Preferably, each drive means 20, 21 comprises a driving pulley 24, 25 the axis of rotation A24, A25 of which is horizontal, and two diverting pulleys 26 to 29 the axes of rotation A26 to A29 of which are also horizontal. The hanger arms 31 are situated underneath the carriers 4 to 10, preferably in the middle of the carrier. Each carrier 4 to 10 is equipped with at least one pair of wheels 35 to run on the bypass circuits C1, C2, on the disengagement circuits C3, C4, and on the support rails C5 and C6 of the support structure of the installation 1. It can be noted in FIG. 9 that the first running track X comprises a disengagement circuit C3, and that the bypass circuit C1 is distinct from the support rails C5. The second running track Y does not comprise a disengagement circuit, and the bypass circuit C2 coincides with the support rails C6.

In general manner, each drive means 20, 21 comprises a tensioning system of the hauling cable 2, 3 which it drives. The tensioning system can be a hydraulic or pneumatic jack mounted on the frame of the driving pulley 24, 25 to move the latter, and consequently to move the hauling cable 2, 3, in order to place it under tension. As a variant, the tensioning system is formed by the two diverting pulleys 26 to 29.

The invention which has just been described in the foregoing is particularly suitable for any type of cable transport installation, in particular an installation with an aerial or a ground hauling cable. The invention ensures a minimum passenger transit rate while at the same time minimizing the size of the terminal stations.

The invention claimed is:

1. Cable transport installation, comprising:

at least one terminal, at least one first carrier and at least one second carrier, a first hauling cable to haul the at least one first carrier and describing a first closed loop passing though the at least one terminal, and a second hauling cable to haul the at least one second carrier and describing a second closed loop passing though the at least one terminal, wherein the at least one terminal comprises:

a first driving pulley driving the first hauling cable and two first diverting pulleys diverting the first hauling cable in a first direction toward the first driving pulley, and a second driving pulley driving the second hauling cable and two second diverting pulleys diverting, the second hauling cable in a second direction toward the second driving pulley, the second driving pulley being distinct from the first driving pulley the second loop surrounds the first loop so as to create a separating space between the first and second hauling cables, the axis of rotation of the first and second driving pulleys and the axis of rotation of the first and second diverting pulleys are vertical, the first driving pulley is positioned outside the first closed loop, the second driving pulley is positioned inside the second closed loop, the at least one terminal comprises a first bypass circuit where the at least one first carrier runs so as to bypass the first driving pulley, the at least one first carrier being uncoupled from the first hauling cable, and the at least one terminal comprises a second bypass circuit where the at least one second carrier runs so as to bypass the second driving pulley, the at least one second carrier being uncoupled from the second hauling cable.

2. Installation according to claim 1, comprising a loading/unloading platform situated inside the separating space.

3. Installation according to claim 1, wherein each of the at least one first carrier and the at least one second carrier is equipped with a detachable clamp to couple said at least one first carrier and said at least one second carrier in removable manner to the first hauling cable and to the second hauling cable.

4. Installation according to claim 1, comprising:

a running space situated between the two first diverting pulleys, and a disengagement circuit for at least one of the first carriers passing through the running space in order to remove said at least one first carrier from the first hauling cable, or a running space situated between the two second diverting pulleys, and a disengagement circuit for at least one of the second carriers passing through the running space in order to remove said at least one second carrier from the second hauling cable.

5. Installation according to claim 1, wherein the first and second hauling cables are aerial hauling cables suspended above the ground and at least one carrier of the first and second carriers comprises a cabin and a hanger arm coupling the cabin to the clamp of said at least one carrier of the first and second carriers, the hanger arm being situated inside the separating space when said at least one carrier of the first and second carriers is coupled to at least one of the first and second hauling cables.

6. Installation according to claim 1, wherein the at least one terminal comprises a platform.

7. Installation according to claim 1, wherein the installation comprises only one hauling cable for propelling the first carrier and only one hauling cable for propelling the second carrier.

8. Cable transport installation, comprising:

at least one carrier, a first hauling cable to haul at least one carrier and describing a first closed loop, a second hauling cable to haul at least one carrier and describing a second closed loop, a first running track for said at least one carrier hauled by the first hauling cable, and a second running track for said at least one carrier hauled by the second hauling cable, a first driving pulley for driving the first hauling cable along the first running track and a second driving pulley for driving the second hauling cable along the second running track, the second driving pulley being distinct from the first driving pulley, two diverting pulleys to divert at least one hauling cable in the direction of at least one driving pulley, a running space situated between the two diverting pulleys, and a disengagement circuit for at least one carrier passing through the running space in order to remove said at least one carrier from said at least one hauling cable, wherein the second loop surrounds the first loop so as to create a separating space between the first and second hauling cables, and wherein the axis of rotation of said at least one driving pulley and the axes of rotation of the diverting pulleys are horizontal.

9. Installation according to claim 8, comprising a loading/unloading platform situated inside the separating space.

10. Installation according to claim 8, comprising at least one carrier equipped with a detachable clamp to couple said at least one carrier in removable manner to at least one hauling cable.

11. Installation according to claim 8, wherein the first and second hauling cables are aerial hauling cables suspended above the ground and at least one carrier comprises a cabin and a hanger arm coupling the cabin to the clamp of said at least one carrier, the hanger arm being situated inside the separating space when said at least one carrier is coupled to at least one hauling cable.

12. Cable transport installation, comprising:

at least one carrier, a first hauling cable to haul at least one carrier and describing a first closed loop, a second hauling cable to haul at least one carrier and describing a second closed loop, a first running track for said at least one carrier hauled by the first hauling cable, and a second running track for said at least one carrier hauled by the second hauling cable, the length of the first running track being shorter than that of the second running track, a first driving pulley for driving the first hauling cable along the first running track and a second driving pulley for driving the second hauling cable along the second running track, the second driving pulley being distinct from the first driving pulley, two diverting pulleys to divert at least one hauling cable in the direction of at least one driving pulley, two inflection pulleys to bend at least one hauling cable in the direction of said at least one driving pulley, the axis of rotation of said at least one driving pulley is vertical, and the axes of rotation of the diverting pulleys and inflection pulleys are horizontal, wherein the second loop surrounds the first loop so as to create a separating space between the first and second hauling cables.

13. Installation according to claim 12, comprising a loading/unloading platform situated inside the separating space.

14. Installation according to claim 12, comprising at least one carrier equipped with a detachable clamp to couple said at least one carrier in removable manner to at least one hauling cable.

15. Installation according to claim 12, wherein the first and second hauling cables are aerial hauling cables suspended above the ground and at least one carrier comprises a cabin and a hanger arm coupling the cabin to the clamp of said at least one carrier, the hanger arm being situated inside the separating space when said at least one carrier is coupled to at least one hauling cable.

16. Installation according to claim 12, wherein the first driving pulley and the second driving pulley are positioned on a first level located below a second level where the diverting pulleys are positioned.

* * * * *